United States Patent [19]

Popiel et al.

[11] 4,186,837

[45] Feb. 5, 1980

[54] AUTOMATED FILM CARTRIDGE AND MAILER SORTING AND CORRELATING APPARATUS

[75] Inventors: Stanley Popiel, Stonington; R. Clark DuBois; Jay L. Carley, both of Fairfield; John C. Hamma, Milford, all of Conn.

[73] Assignee: Mystic Color Lab, Inc., Mystic, Conn.

[21] Appl. No.: 973,612

[22] Filed: Dec. 27, 1978

[51] Int. Cl.[2] ..... B07C 5/34

[52] U.S. Cl. ..... 209/565; 209/598; 209/600; 209/933

[58] Field of Search ..... 209/565, 566, 598, 600, 209/933, 569, 583, 584; 101/2

[56] References Cited

U.S. PATENT DOCUMENTS

| | | | |
|---|---|---|---|
| 3,246,752 | 4/1966 | Wilson et al. | 209/588 |
| 3,402,811 | 9/1968 | Nerwin | 209/598 |
| 3,402,812 | 9/1968 | Nerwin | 209/598 |

*Primary Examiner*—Allen N. Knowles

[57] ABSTRACT

A conveyor moves a series of cartridges containing undeveloped film and sender-identified mailers in correlated side-by-side relation from a loading station past a cartridge sensing station, a dual labeling station, and a plurality of discharge stations. Information sensed from each cartridge is stored in a memory and later controls the off-loading of the correlated cartridges and mailers at an appropriate one of the discharge stations from which the cartridges go their separate ways for film processing. Prior to off-loading, the side-by-side cartridge and mailer receive separate labels preprinted with correlating indicia enabling the developed film and the mailer to be correctly reunited for return to the sender.

35 Claims, 13 Drawing Figures

STEP
MAILER SENSE
MULTIPLE ORDER
CARTRIDGE SENSE
MAGAZINE SW 114
RESET SW 131
NOTCH READER
MANUAL ENTRY 28a
FIRST SEQUENCER 134
DECODER 154
REG
F/F
OS
SR
TTOS
CLOS
SFS
RSF
OLOS-A
OLOS-B
OLOS-C
OLOS
PKOK
POS
ROS
D
A
B
C

AUTOMATED FILM CARTRIDGE AND MAILER SORTING AND CORRELATING APPARATUS

BACKGROUND OF THE INVENTION

The present invention relates to automated apparatus for the mass sorting of individual cartridges of undeveloped film into various groups according to the particular film processing required.

Mail order film processing firms receive daily thousands of cartridges of exposed film sent in for developing. This film must not only be sorted into their various types so that they go through the appropriate developing process, but also must be suitably identified or correlated with the sender so that the developed film is correctly returned. Originally these sorting and correlating functions were performed on a manual basis. Recently, film manufacturers have taken to providing a notch code on the cartridge identifying the type of film therein and the particular processing required to properly develop it. This notch code is then sensed pursuant to controlling automated sorting apparatus. An example of one such sorting apparatus is seen in U.S. Pat. No. 3,402,811.

The problem still remains to correlate each sorted film cartridge with the identity of the person mailing it in for developing. Heretofore, this has been done on an essentially manual basis. One method of providing this correlation function has been to manually apply identical uniquely numbered labels to the film cartridge and a mailing envelope or mailer in which the developed film will be returned to the sender. An address strip filled out by the sender and sent in with the film cartridge is inserted in the mailer. Thus the mailer is correlated with the sender by the enclosed address strip, and the film is correlated with the mailer by the two identically numbered labels. When the developed film returns, its label number, which was photographed on the film strip prior to processing, provides the basis for locating the appropriate mailer pursuant to transmittal of the developed film back to the correct sender.

It is accordingly an object of the present invention to provide automated apparatus for not only sorting film cartridges for processing, but also for correlating each film cartridge with a particular mailing envelope or mailer containing an identification of the person to receive the developed film.

A further object is to provide automated apparatus of the above character wherein sorting of the film cartridges is achieved in a rapid and efficient manner.

Another object of the present invention is to provide automated apparatus of the above character which handles each film cartridge and its correlated mailer in positional association.

Yet another object is to provide automated apparatus of the above character wherein correlating labels are automatically applied to each cartridge and its correlated mailer prior to sorting.

An additional object is to provide automated apparatus of the above character wherein the correlated cartridges and mailers are sorted concurrently.

A further object is to provide automated apparatus of the above character which is efficient and reliable in operation and compact in size.

Other objects of the invention will in part be obvious and in part appear hereinafter.

SUMMARY OF THE INVENTION

In accordance with the present invention, there is provided automated apparatus for sorting cartridges of undeveloped film and for providing correlation between each cartridge and an envelope or mailer containing an address strip identifying the person to whom the film, once developed, is to be sent. The apparatus comprises a conveyor having a series of conveyor sections sequentially presented at a loading station where a film cartridge and a mailer containing the film owner's address are loaded thereon in side-by-side relation. In response to the joint loading of a cartridge and mailer on a conveyor section, the conveyor is automatically indexed through a sensing station where the type of film in the cartridge is determined. In the disclosed embodiment, this determination is made on the basis of the reading of a notch code applied to the cartridge by the film manufacturer. The notch code reading is stored as digital data in a memory and shifted through the memory with each indexing of the conveyor, such that the individual digital data tracks the conveyance of its associated cartridge and mailer through a dual labeling station and a plurality of discharge stations. When a cartridge and mailer on a particular conveyor section arrive at the appropriate discharge station, the associated data in the memory controls the activation of means operating to off-load them for accumulation with previously sorted cartridges containing the same film type.

From the discharge stations the cartridges are taken for film processing, and thus the positional correlation between associated cartridges and mailers while on the conveyor is unavoidably lost. In accordance with the present invention, cartridge and mailer correlation is preserved, despite the fact that from the discharge stations the cartridges and mailers go their separate ways. To this end, before each conveyor section arrives at the first one of the plural discharge stations, it is presented at a labeling station where a pair of gum labels preprinted with corresponding indicia are automatically applied to the cartridge and mailer. Thus when the film comes back developed, its label indicia is utilized in locating the mailer bearing the corresponding label indicia, whereupon the correlated film and mailer are reunited for return to the proper owner.

In some instances the film owner may send in two or more cartridges for film development in a single envelope. The apparatus of the present invention is uniquely structured to accommodate these multiple order situations in an efficient and reliable manner. The person at the loading station, who incidentally is also the sole operator of the apparatus, places the first one of the cartridges and a mailer on one of the conveyor sections. The conveyor is automatically indexed to move this first cartridge through the reading station. On the next succeeding conveyor section then presented at the loading station, the operator loads the second cartridge of the multiple order, but no mailer. The operator then presses a multiple order button signaling the conveyor to index this second cartridge through the reading station. Additional cartridges of a multiple order are handled in the same manner. When the first cartridge and its associated mailer arrive at the labeling station, they receive corresponding labels in the manner described. However, prior to the next indexing of the conveyor, the absence of a mailer on the succeeding conveyor section is sensed. In response, a lift mechanism situated at the labeling station raises the mailer from its conveyor section and holds it aloft while the next succeeding conveyor section is being indexed to the labeling station. The mailer is then lowered onto this conveyor section where it and the second cartridge receive correlating labels. While held aloft, the mailer is positionally incremented in order that the second label is not applied to the mailer directly over the first label. If the succeeding conveyor section lacks a mailer, this operation is automatically repeated to apply a third label to the mailer, and so on. The multiple labeled mailer is off-loaded at the discharge station called for by the last cartridge of a multiple order. When the developed films of a multiple order return from processing, their individual labels make it possible to locate the single mailer bearing the plural corresponding labels pursuant to sending them to the correct owner.

The invention accordingly comprises the features of construction, combination of elements and arrangement of parts which will be exemplified in the construction hereinafter set forth, and the scope of the invention will be indicated in the claims.

For a better understanding of the nature and objects of the invention, reference should be had to the following detailed description taken in conjunction with the accompanying drawings, in which.

Figure 1:
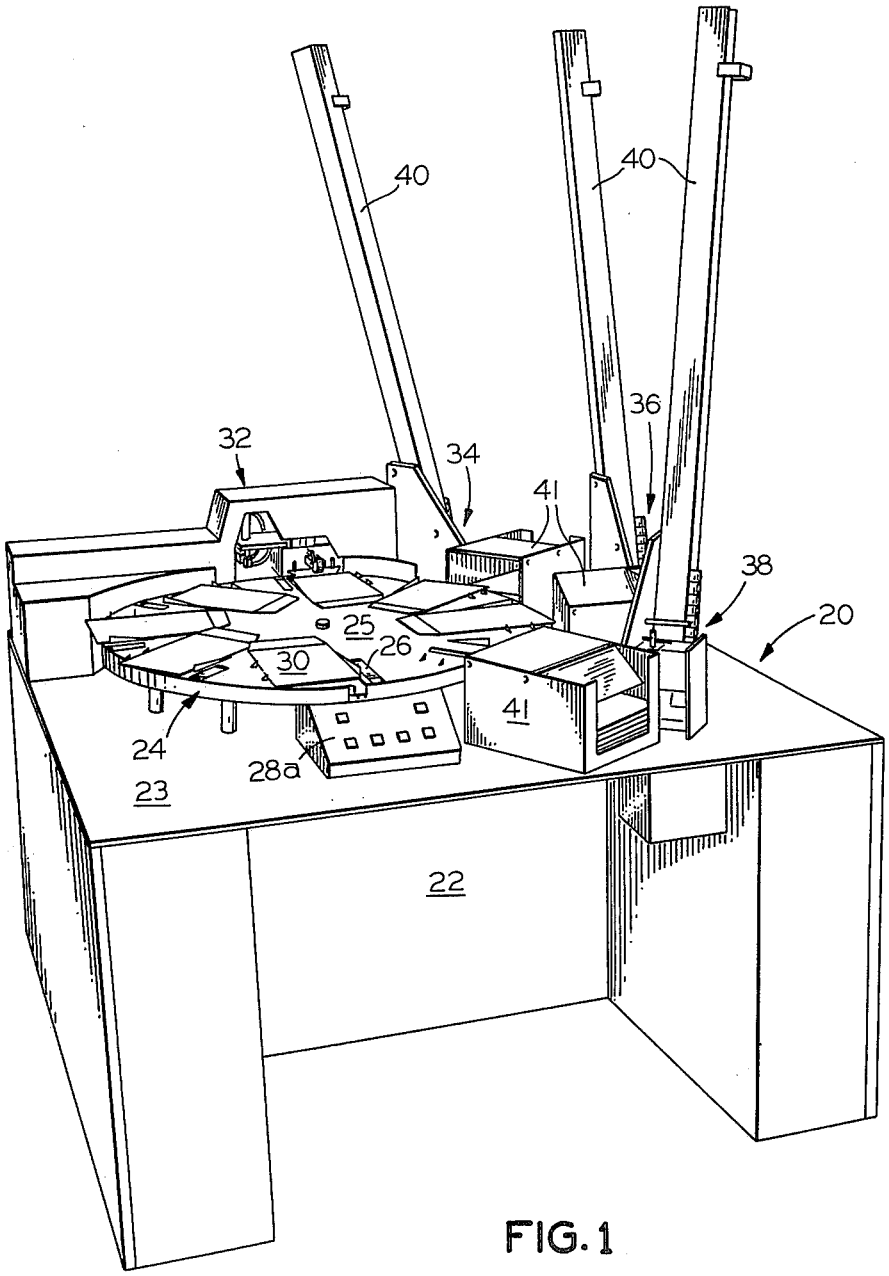
FIG. 1 is a perspective view of automated film cartridge and mailer sorting and correlating apparatus constructed in accordance with the invention.
Figure 11A:
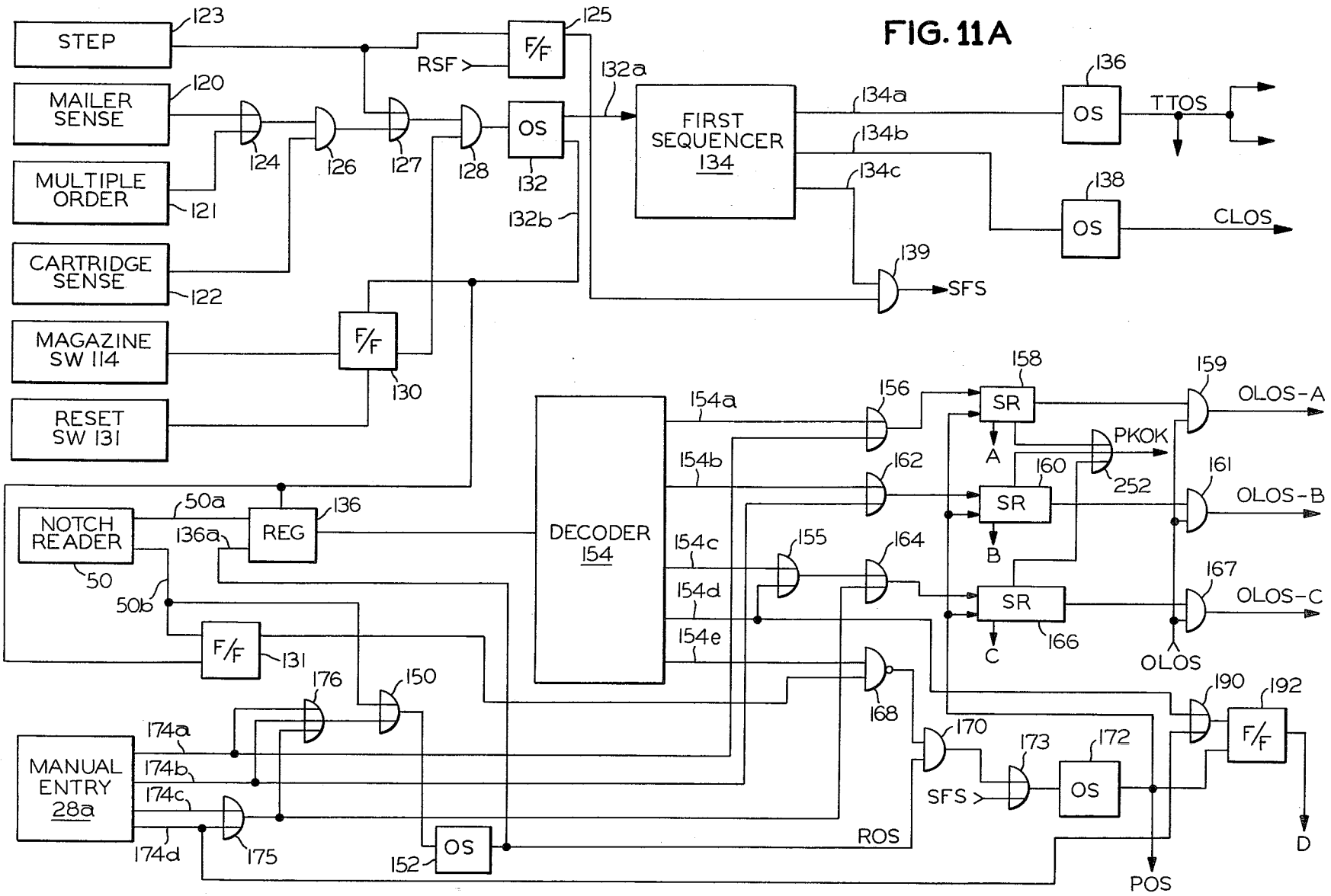
Figure 11B:
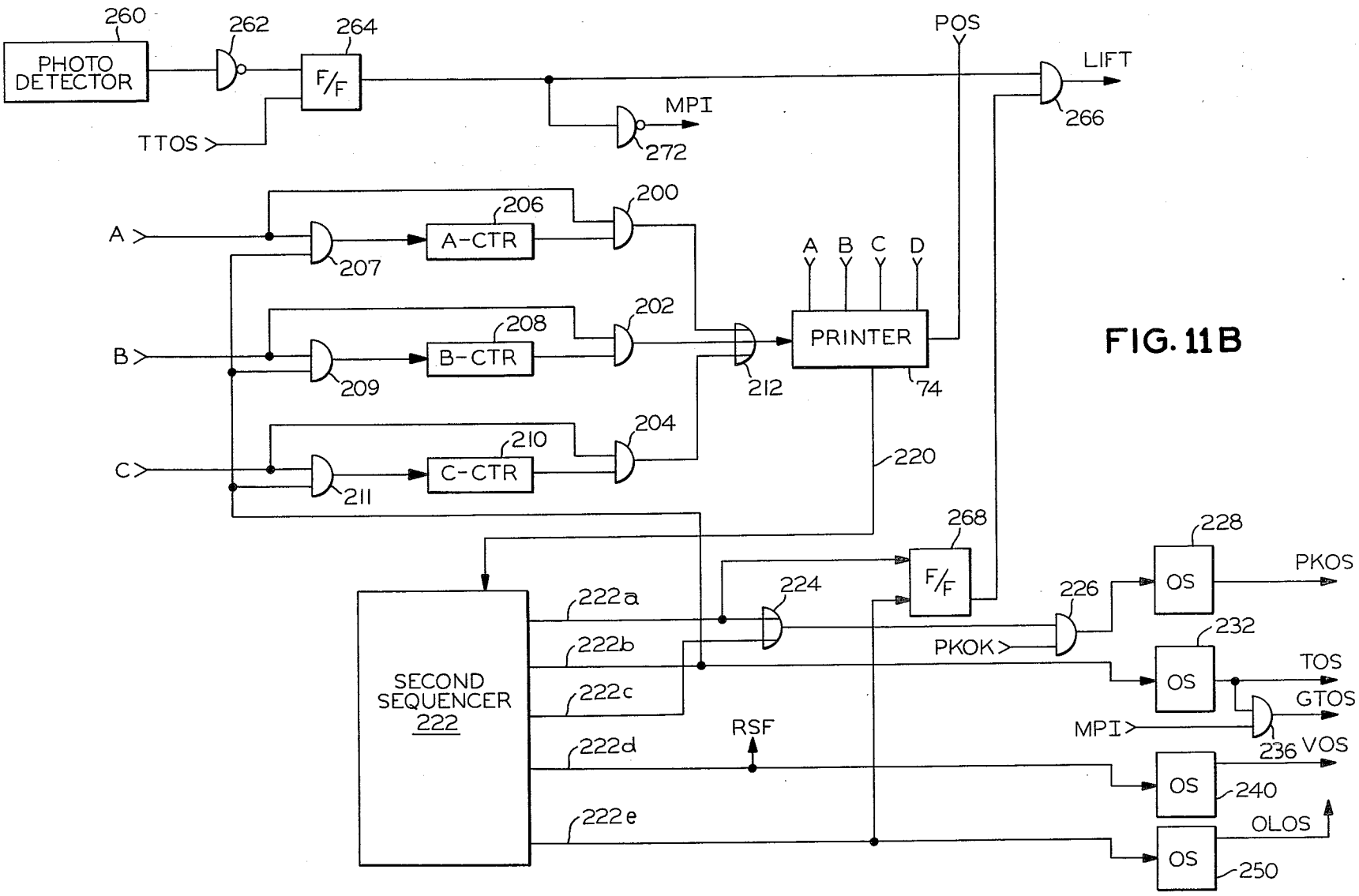
Figure 12:
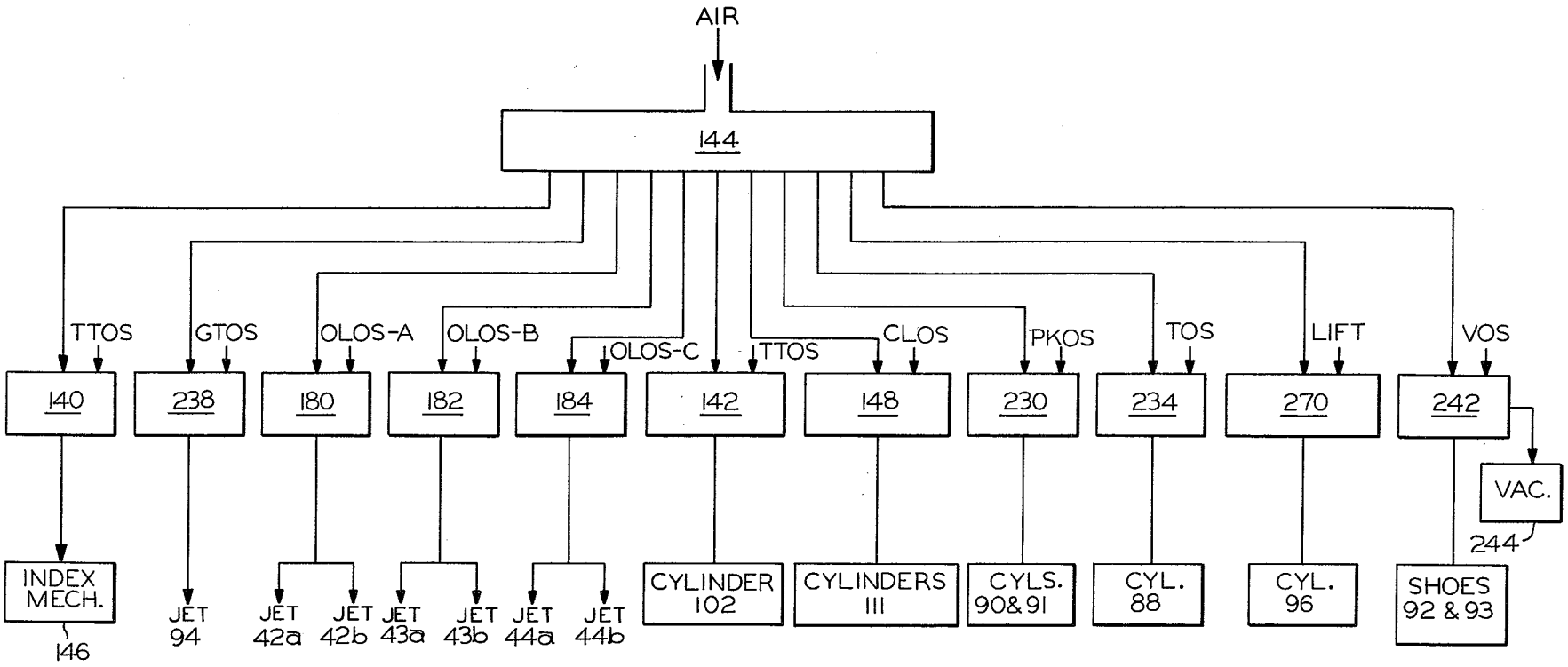

FIGS. 11A and 11B, taken together, comprise a schematic diagram, partially in logic block form, of electronic control circuitry for the apparatus of FIG. 1; and FIG. 12 is a schematic diagram of a pneumatic actuating network for the apparatus of FIG. 1.

Corresponding reference numerals refer to like parts throughout the several views of the drawings.

DETAILED DESCRIPTION

The film cartridge and mailer sorting and correlating apparatus of the present invention, generally indicated at 20 in FIG. 1, includes a console 22 having a planar work surface 23 supporting a circular conveyor, generally indicated at 24. The conveyor has a circular table 25 divided up into an annular array of conveyor sections 24*a*, more clearly illustrated in FIG. 2. Each conveyor section includes a slot 25*a* in the table into which a film cartridge 26 (FIG. 1) is manually loaded when the conveyor sections are successively presented at a loading station 28, identified in FIG. 1 by the presence of a console panel 28*a*. Plural edge guide elements 29 serve to positionally locate in overlying relation with an elongated table slot 25*b* an envelope or mailer 30 (FIG. 1) also normally loaded onto each conveyor section upon its arrival at the loading station.

Figure 2:
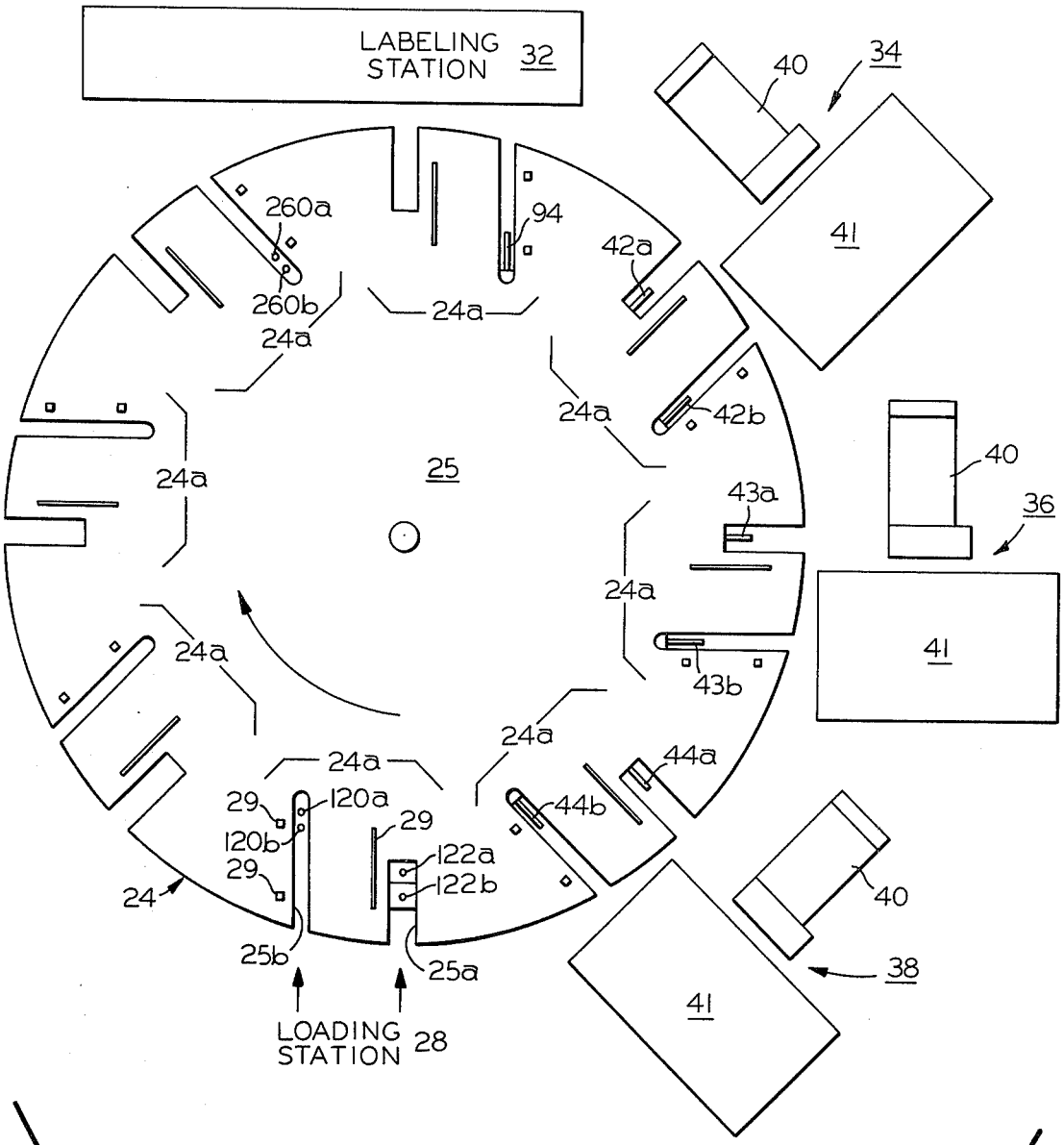
FIG. 2 is a diagrammatic plan view of the apparatus of FIG. 1.

Referring jointly to FIGS. 1 and 2, conveyor 24 indexes each conveyor section successively from loading station 28 through a series of queuing positions, three in the illustrated embodiment to a labeling station generally indicated at 32, where the cartridge 26 and mailer 30 each receive a label preprinted with unique correlating indicia. From the labeling station, the conveyor sections are indexed past a succession of three discharge stations, generally at 34, 36 and 38, respectively, into which the labeled cartridge and mailer of each conveyor section are selectively off-loaded. Each discharge station includes an elongated magazine 40 into which the off-loaded cartridges are accumulated. In the illustrated embodiment, off-loading is effected by the selective activation of pairs of air jets 42*a*–42*b*, 43*a*–43*b*, and 44*a*–44*b* positioned under the conveyor table 25 in confronting relation with the respective discharge stations and in registry with slots 25*a* and 25*b* of the conveyor sections 24*a* present thereat, all as best seen in FIG. 2. Thus, if the cartridge and mailer on the conveyor section indexed to discharge station 34 are to be off-loaded thereat, air jets 42*a* and 42*b* are jointly activated to blow the cartridge off for loading into magazine 40, and its label correlated mailer off into bin 41. Similarly, if a correlated cartridge and mailer are to be off-loaded at discharge station 36, air jets 43*a* and 43*b* are activated, whereas jets 44*a* and 44*b* are activated to off-load a cartridge and mailer into discharge station 38. It should be understood that off-loading of the correlated cartridges and mailers may be accomplished by means other than air jets.

Figure 3:
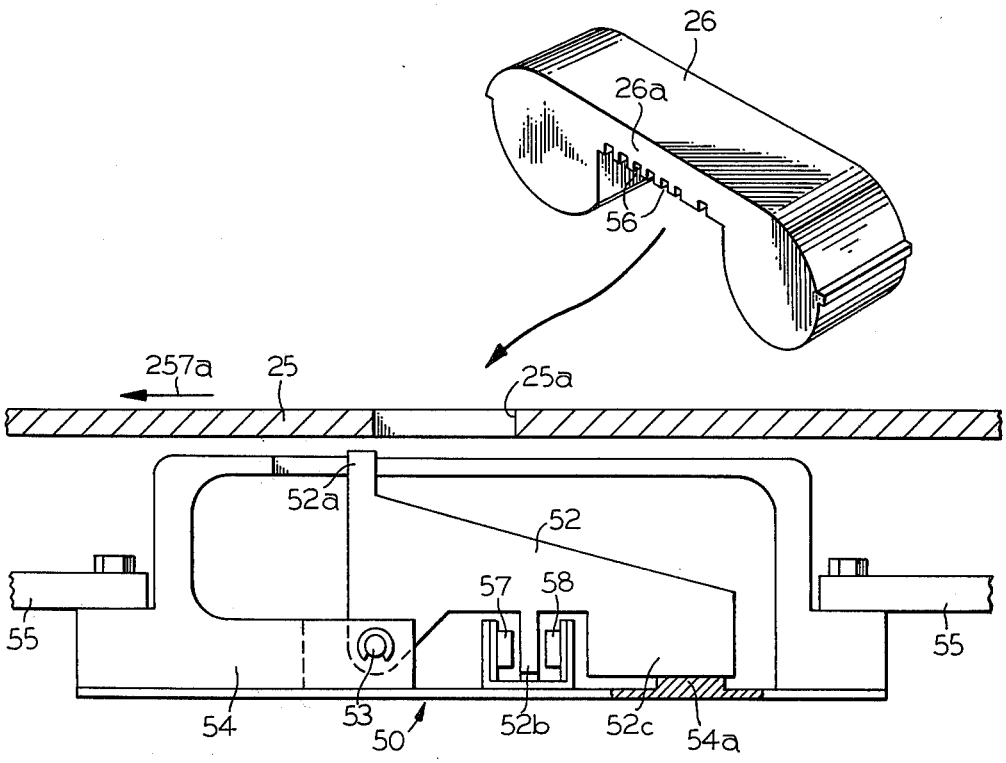
FIG. 3 is a side elevational view, partially broken away, of a film cartridge sensing notch code reader utilized in the apparatus of FIG. 1.

To determine at which of the three discharge stations each correlated cartridge and mailer pair is to be off-loaded, cartridge sensing means, which in the illustrated embodiment of the invention is in the form of a notch code reader, generally indicated at 50 in FIG. 3, is utilized. Preferably this reader is located beneath the conveyor table 25 at a position to intercept each cartridge as it is indexed away from the loading station. The reader includes a plurality of arms 52, best seen in FIG. 4, which are commonly pivotally mounted on a transverse pin 53 carried by a frame 54, in turn supported by bracket members 55. Each arm includes an upstanding notch sensing finger 52*a* and a depending flag 52*b*. The arms normally assume their positions shown under gravity with their weighty extremities 52*c* resting on a raised stop 54*a* carried by frame 54. As previously noted, nearly all film manufacturers now provide a universal notch code on their film cartridges to identify certain characteristics of the film therein, particularly the type of film developing process required and also the number of exposures (film length) present. As seen in FIG. 3, this notch code 56 is suitably formed in an edge 26*a* of the portion of the cartridge case interconnecting the bulbous end portions containing the pay-out and take up rolls. A cartridge is loaded into conveyor table slot 25*a* of the conveyor section 24*a* present at the loading station 28 such that its edge 26*a* is positioned in intercepting relation with the fingers 52*a* when the conveyor table 25 is indexed in the direction of arrow 57a. If the finger of a particular arm 52 encounters a notch, it is seen that this arm is not pivoted upwardly as the just loaded cartridge is indexed away from the loading station. On the other hand, if the finger of a particular arm does not encounter a notch, this arm is pivoted upward, raising its flag to unblock a beam of light transmitted between an emitter 57 and a receiver 58 associated therewith. It is thus appreciated that each receiver 58 responding to a light signal as the cartridge is indexed past notch reader 50 provides an electrical response indicating that its associated arm was momentarily elevated during the reading operation. As will be seen, the signal outputs of the receivers 58 are fed to electronic circuitry controlling the operation of the apparatus. Preferably the flag 52b of a particular arm 52 positioned in reader 50 where, according to the accepted code convention, a notch never appears is made longer than the other flags. Thus, this arm is raised with every code reading operation and, due to the elongation of its flag, the associated receiver 58 generates a uniquely shorter electrical pulse which can be advantageously utilized for signal clocking purposes.

Figure 5:
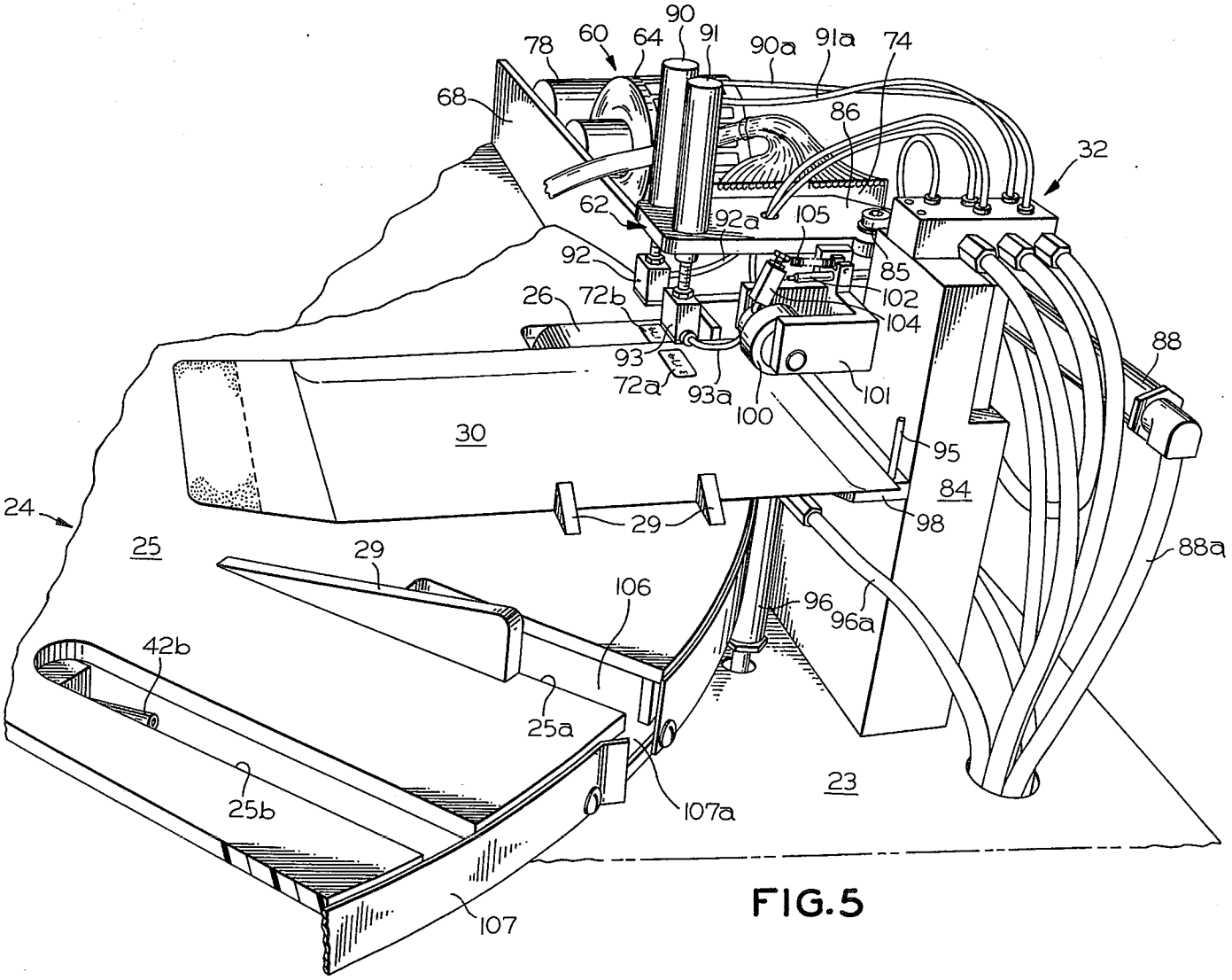
FIG. 5 is an enlarged perspective view, partially broken away, of a dual labeling station utilized in the apparatus of FIG. 1.
Figure 6:
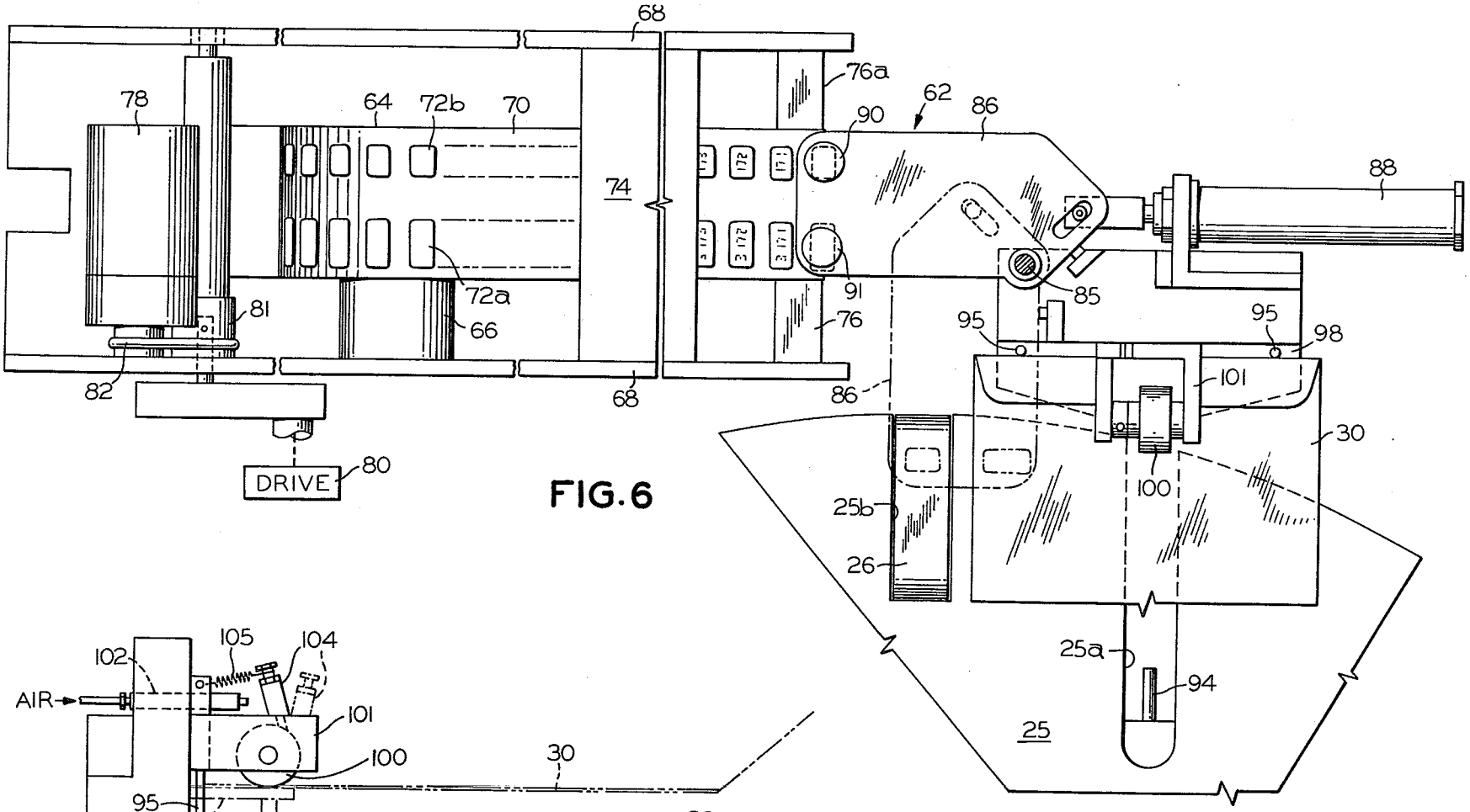
FIG. 6 is a plan view of the labeling station seen in FIG. 5.
Figure 7:
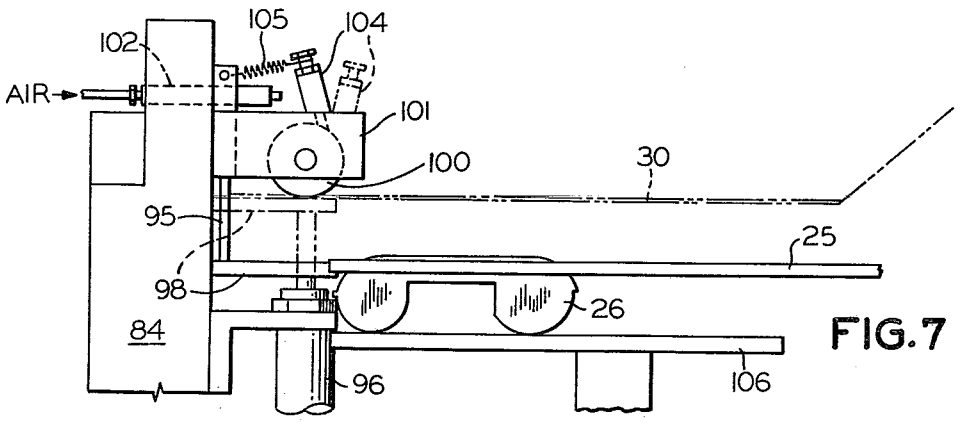
FIG. 7 is a fragmentary side elevational view of a portion of the labeling station of FIG. 5.

The labeling station 32, seen in greater detail in FIGS. 5 through 7, includes a label printing section, generally indicated at 60, and a label transport mechanism, generally indicated at 62. The label printing section comprises a supply roll 64 of blank labels supported on a drum 66 rotatably mounted by a suitable frame 68. The supply roll consists of a continuous backing strip 70 to which are lightly adhered a succession of transversely paired gum labels. As will be seen, the larger label 72a of each pair is transferred to the mailer 30 by the transport mechanism 62, while the smaller label 72b is transferred to the cartridge also by the transport mechanism. From the supply roll, the backing strip 70 is drawn in stepwise fashion through a printer 74 controllably operated to print unique correlating information on each transverse label pair. From the printer, the backing strip is stepped through a succession of label queuing positions, corresponding to the number of conveyor section queuing positions, to a label ready position four label steps removed from the printer. At this ready position the backing strip is drawn around the corner of a bar 76, mounted by frame 68, to partially peel the pairs of labels thereat away from the more flexible backing strip, thereby enabling the transport mechanism to pick the labels for transfer to the cartridge and mailer on the conveyor section 24a presented at the labeling station. The backing strip minus the labels passes beneath the printer 74 and supply roll 64 back to where it is wound onto a take-up roll 78. The take-up roll is driven by a suitable stepping motor drive 80 acting via a roller 81 and a belt 82.

Label transport 62 includes a stand 84 which is mounted on the console table top 23. This stand in turn pivotally mounts at 85 a transfer plate 86 which is driven by an air cylinder 88 between a label pickup position adjacent the label printing section 60, seen in FIG. 6, and a labeling position seen in FIG. 5, overhanging the conveyor section 24a presented at the labeling station 32. The free end of transfer plate mounts side-by-side air cylinders 90 and 91, which, when actuated, vertically reciprocate label pickup shoes 92 and 93, respectively. These pickup shoes are normally connected via tubes to a vacuum source so as to develop suction forces at their perforated bottom surfaces.

Normally, transfer plate 86 is in its label pickup position seen in FIG. 6, such as to position label pickup shoe 92 directly above the preprinted cartridge label 72b at the ready position. In addition, the label pickup position of the transfer plate disposes pickup shoe 93 directly above the mailer label 72a at the ready position. Upon actuation of air cylinders 90 and 91, shoes 92 and 93 are reciprocated to pick these two labels off the backing strip. Then upon actuation of air cylinder 88, transfer plate 86 is swung around to its labeling position of FIG. 5, with the label 72b held by suction against the bottom of shoe 92 poised above the cartridge 26 and the label 72a held by suction against the bottom of shoe 93 poised above the mailer 30, both on the conveyor section 24a presented at the labeling station 32. The air cylinders 90 and 91 are again actuated to reciprocate their shoes downward, pressing the gummed backs of the labels against the surfaces of the cartridge and mailer to be labeled. To insure reliable transfer of the labels from the pickup shoes into adherence with the cartridge and mailer, the shoes are momentarily disconnected from the vacuum source and connected to a positive pressure air source while pressing the labels against the cartridge and mailer. Air cylinders 90 and 91 return the shoes 92 and 93 to their elevated positions, whereupon air cylinder 88 returns transfer plate 86 to its label pickup position of FIG. 5. To insure precise positioning of a label 72a on a mailer 30, an air jet 94, seen in FIGS. 2 and 6 is selectively activated after the arrival of a mailer at the labeling station to blow it out toward the transport mechanism 62, registering its bottom edge against a pair of stop pins 95 seen in FIG. 6.

Figure 8:
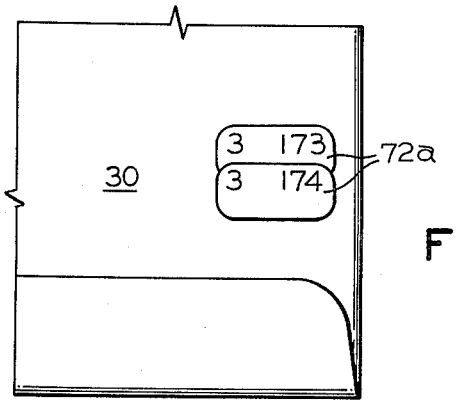
FIG. 8 is a fragmentary plan view of a multiply labeled mailer.

As will be considered in detail later, multiple order situations call for a single mailer 30 to receive multiple labels 72a correlating it with the several cartridges 26 of the multiple order. To accommodate this situation, a mailer and one of the cartridges of a multiple order are loaded onto one conveyor section 24a at the loading station 28 (FIG. 2), and the remaining cartridges of a multiple order are individually loaded onto successive conveyor sections without associated mailers. When the conveyor section carrying the first cartridge of a multiple order and its associated mailer is indexed to labeling station 32, they receive preprinted correlating labels 72a, 72b in the manner described. Before this conveyor section is indexed away from the labeling station, the absence of a mailer on the next succeeding conveyor section is automatically sensed. An air cylinder 96 is then actuated to elevate a platform 98 mounted by stand 84 in underlying relation with the portion of mailer 30 overhanging the edge of conveyor table 25. The mailer is thus lifted from the conveyor into engagement with a roller 100 mounted by a bracket 101 affixed to stand 84. As seen in FIG. 7, while the mailer is elevated, an air cylinder 102 is actuated and its plunger strikes an oscillatingly mounted pawl 104, swinging it generally in the clockwise direction. Upon deactuation of air cylinder 102, a spring 105 returns pawl 104 to its normal counterclockwise-most position. In the process, the pawl ratchets roller 100 through an increment of counterclockwise rotation. It is seen that mailer 30 is thus indexed through an increment of movement away from transport mechanism 62. When the conveyor is next indexed, the first cartridge of a multiple order leaves the labeling station without its label correlated mailer. Upon arrival of the next conveyor section at the labeling station bearing the second cartridge of a multiple order, air cylinder 96 is deactuated, and platform 98 lowers to place the previously labeled mail onto the conveyor section thereat. Activation of air jet 94 is inhibited in this situation so that the mailer is not blown out into registry with stop pins 95. Consequently the mailer rests on this conveyor section with its bottom edge spaced from the stop pins by the increment of movement imparted by roller 100. Consequently, when the label transport mechanism goes through its operating cycle, the second label 72*a* is not applied to the mailer directly over the first label. As seen in FIG. 8, the second label is applied in slightly overlapping relation with the first label without obscuring the correlating indicia imprinted thereon. Of course this second cartridge receives a label 72*b* bearing printed indicia corresponding to the indicia imprinted on the second label 72*a* applied to the mailer.

Similarly, if no mailer is sensed on the next succeeding conveyor section, signifying a third cartridge of a multiple order, the twice labeled mailer is again elevated by platform 98, indexed by roller 100, and then deposited on the next succeeding conveyor section when it is indexed to the labeling station. The label transport mechanism then goes through its operating cycle to apply a label 72*b* to the cartridge and a correlating third label to the mailer in partially overlapping relation with the second label. It will be appreciated that this could go on indefinitely, limited only by the labeling space available on the mailer. The multi-labeled mailer leaves the labeling station with the last cartridge of the multiple order and is off-loaded at the discharge station called for by the data read from the notch code carried by this last cartridge.

As generally described previously, in connection with FIGS. 1 and 2, each of the discharge stations 34, 36 and 38 includes a magazine 40 into which the cartridges are accumulated and a bin 41 for accumulating the mailers. As best seen in FIG. 5, each cartridge rests on a stationary floor 106 immediately beneath conveyor table 25 while extending upwardly through a slot 25*a* to dispose its label-receiving back surface in substantially flush relation with top surface to the conveyor table. Thus, when table 25 is indexed, the cartridges slide over the floor 106. A circumferential fence 107 mounted to floor 106 prevents the cartridges from escaping their slots 25*a* except at each discharge station where a break 107*a* in the fence is provided. Thus, as the conveyor sections arrive at the discharge stations, their cartridge accommodating slots 25*a* line up with the fence breaks 107*a*.

Figure 9:
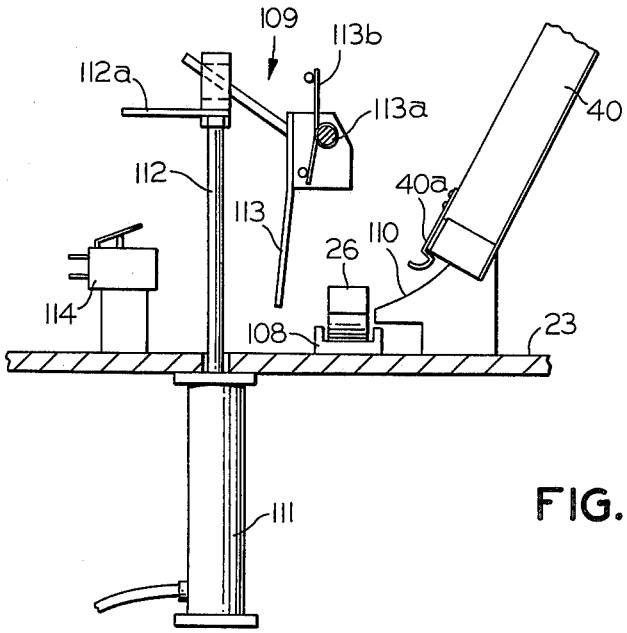
FIG. 9 is a fragmentary elevational view of a portion of one of the discharge stations utilized in the apparatus of FIG. 1.
Figure 10:
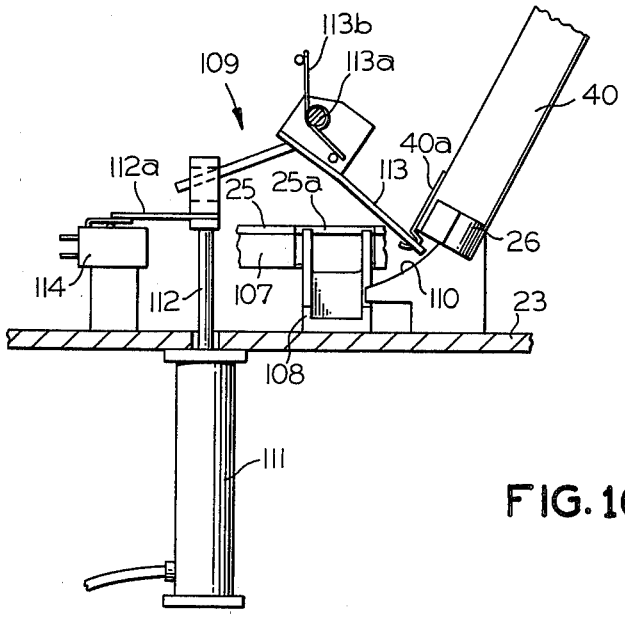
FIG. 10 is a fragmentary elevational view of the same discharge station portion seen in FIG. 9, illustrating a cartridge magazine loading operation.

Referring to FIGS. 9 and 10, when a cartridge is to be off-loaded at a particular discharge station, the appropriate air jet 42*a*, 43*a* or 44*a* (FIG. 2) is activated to blow it off the conveyor 24 through the aligned break in fence 107. The momentum of the cartridge carries it down a chute 108 to a mechanism, generally indicated at 109 and shown somewhat diagrammatically for simplicity's sake, operating to load a discharged cartridge 26 into a magazine 40. At the end of the chute the cartridge is stopped abreast of an arcuate ramp 110 leading up into the bottom-opening mouth of the magazine. An air cylinder 111 is actuated to reciprocate its plunger 112 downward, causing a loading arm 113, coupled therewith, to be swung in the counterclockwise direction about its pivot mount 113*a*. The loading arm thus propels a discharged cartridge up ramp 110 into magazine 40 (FIG. 10). A spring clip 40*a* prevents the cartridges loaded into the magazine from falling back out. Upon deactuation of air cylinder 111, its plunger returns to its extended condition, while a torsion spring 113*b* insures that loading arm 113 is returned to its clockwise-most position. Each time a cartridge is loaded into magazine 40, an arm 112*a*, carried by plunger 112, descends into actuating engagement with a switch 114, as seen in FIG. 10. When the magazine 40 becomes full, loading arm 113 will be unable to propel another cartridge into the magazine. Consequently, plunger 112 cannot fully retract to bring arm 112*a* into actuating engagement with switch 114. As will be seen, the absence of an actuation of one of the discharge station switches 114 during an apparatus operating cycle inhibits initiation of the next cycle. Also a light is lit at the console panel 28*a* (FIG. 1), signaling the operator that one of the discharge station magazines 40 is full and must be replaced with an empty one.

Coordination of the various operating functions thus far described is achieved by the electronic circuit of FIGS. 11A and 11B which operates to selectively control the pneumatic actuating network of FIG. 12 in motivating these operating functions. Referring first to FIG. 11A, block 120 represents a signal input generated by an optically coupled light emitter 120*a* and receiver 120*b* positioned beneath conveyor table 25 in registry with slot 25*b* of each conveyor section 24*a* presented at the loading station 28 as seen in FIG. 2. Block 122 represents a signal input generated by an optically coupled light emitter 122*a* and receiver 122*b* positioned beneath the conveyor table in registry with the slot 25*a* of each conveyor section presented at the loading station, again as seen in FIG. 2. The loading of a mailer onto the conveyor section at the loading station is sensed by receiver 120*b* which then applies a signal through an OR gate 124 to one input of an AND gate 126. Receiver 122*b*, upon sensing the loading of a cartridge into slot 25*a*, applies a signal to the other input of AND gate 126. With signals present at both of its inputs, this gate opens to apply a signal through an OR gate 127 to one input of an AND gate 128 whose other input normally receives an enabling signal input from the reset output of a flip flop 130. Thus under normal conditions, an output from gate 128, signifying that both a mailer and a cartridge have been properly loaded onto the conveyor section presented at the loading station, passes through gate 128 to trigger a one-shot multivibrator 132. In response, this one-shot issues one pulse on an output lead 132*a* going to a sequencer 134 and a complimentary second pulse over output lead 132*b* to clear a data register 136 and set flip flop 130 on its leading edge and reset a flip flop 131 on its trailing edge. Upon receipt of its pulse, sequencer 134 issues in appropriately timed sequence a first pulse on lead 134*a* to trigger a one-shot multivibrator 136, a second pulse on lead 134*b* to trigger a one-shot multivibrator 138, and a third pulse on lead 134*c* to one input of an AND gate 139. One-shot 136, when triggered, issues a conveyor indexing pulse TTOS which is fed jointly to energize solenoid actuated valves 140 and 142 seen in FIG. 12. Valve 140 opens to supply high pressure air from a manifold 144 to actuate a pneumatic indexing mechanism 146 functioning to index table 25 of conveyor 24 one step. Concurrently, valve 142 is opened in response to pulse TTOS to supply air from manifold 144 to actuate air cylinder 102. As previously described in connection with FIGS. 5 through 7, this air cylinder operates in conjunction with spring 104 to index roller 100 and thus index any mailer 30 elevated by platform 98 prior to the indexing step of table 25 pursuant to handling a multiple order situation.

Returning to FIG. 11A, the triggered one-shot 138 issues a cartridge load pulse CLOS which is supplied to solenoid actuated valve 148 seen in FIG. 12. In response, this valve opens to supply air from manifold 144 jointly to the air cylinder 111 (FIGS. 9 and 10) at each discharge station 34, 36 and 38. Arms 113 are thus articulated to load the cartridge 26 previously off-loaded at one of the discharge stations into magazine 40 thereat. In the process, switch 114 is actuated and, as seen in FIG. 11A, its closure applies a signal to return flip-flop 130 from its set condition imposed by the pulse output of one-shot 132 to its reset condition, thereby enabling AND gate 128 for the next conveyor indexing step. However, if the magazine 40 is full, switch 114 is not actuated, and flip-flop 130 is left in its set condition imposed by the triggering of one-shot 132. AND gate 128 therefore remains disabled and triggering of one-shot 132 pursuant to initiating the next operating cycle is precluded. To clear this condition, the operator replaces the full magazine with an empty one and closes a reset switch 131, forcing flip-flop 130 to its reset condition. Gate 128 then becomes enabled and one-shot 132 is triggered to initiate an operating cycle upon the joint loading of a cartridge and mailer at the loading station 28.

In a multiple order situation, when only a cartridge is to be loaded onto a conveyor section, there is no mailer sensing input 120 to act in conjunction with the cartridge sensing input 122 in enabling AND gate 126. It thus remains for the operator to press a multiple order switch 121 and thereby apply a simulated mailer sensing input through OR gate 124 to AND gate 126 pursuant to initiating an operating cycle.

In certain circumstances, such as to clear the conveyor at the end of a day, manual initiation of an operating cycle is desired. To this end, console panel **28*a* includes a step push-button 123 which is depressed to generate a step signal which is routed through OR gate 127 and AND gate 128, assuming none of the discharge stations magazines 40 are full, to trigger one-shot 132. This step signal also sets a flip-flop 125, whose set output then enables AND gate 139 to pass the third pulse issuing on sequencer output lead 134*c*** as a signal SFS. As will be seen, this signal is utilized to initiate the second half of the operating cycle, despite the fact that no cartridge data entry has been effected.

Figure 4:
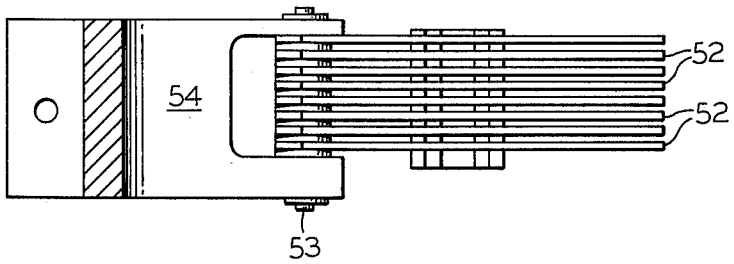
FIG. 4 is a fragmentary plan view of the notch code reader of FIG. 3.

Still referring to FIG. 11A, as conveyor 24 executes its indexing step, moving the just loaded cartridge through notch reader 50 previously described in conjunction with FIGS. 3 and 4. The notch code reading is applied via multiple leads **50*a* to separate inputs of data register 136. The clocking pulse generated by articulation of the single arm 52 having the elongated flag 52*b* is supplied over lead 50*b* to set flip-flop 131 and through an OR gate 150 to trigger a read one-shot multivibrator 152. This one-shot then issues a pulse ROS which is fed to a separate clocking input 136*a* of data register 136, conditioning this register to accept entry of the notch code reading from notch reader 50. The notch code reading entered in the data register is then processed by a decoder 154 acting to develop a binary ONE on one of its plural output leads, namely, leads 154*a*, 154*b*, 154*c*, 154*d*, and 154*e* in the illustrated embodiment. If the notch code reading from a particular cartridge signifies that it is to be off-loaded at discharge station 34, a binary ONE signal should appear at decoder output lead 154*a*. This signal is fed through an OR gate 156 for presentation to the input of a shift register 158. Similarly, if the notch code read from a cartridge signifies that it be off-loaded at discharge station 36, a binary ONE signal should appear on decoder output lead 154*a* for application to the input of a shift register 160 via an OR gate 162. Off-loading of a particular cartridge at discharge station 38 is signified when the decoding of its notch code reading results in a binary ONE signal appearing on either decoder output leads 154*c* or 154*d*. Binary ONES on leads 154*c* and 154*d* signify the same film type, but a binary ONE on the former signifies, for example, a twelve exposure film and on the latter a twenty exposure film. These two decoder output leads are applied as separate inputs to an OR gate 155, whose output is routed through an OR gate 164 to the input of a shift register 166. If the decoding of a notch code reading does not give rise to a binary ONE signal on any one of decoder output leads 154*a*, 154*b*, 154*c*, and 154*d*, a binary ONE signal is generated on decoder output lead 154*e*. This signal is applied together with the then binary ONE set output of flip-flop 131 to a NAND gate 168, whose output goes to a binary ZERO disabling AND gate 170. With this gate disabled, pulse ROS, issued by one-shot 152 in response to the clocking pulse from notch reader 50 is inhibited from triggering a print one-shot multivibrator 172, as applied thereto through an OR gate 173. With the consequence absence of an output pulse POS from this one-shot, the shift registers 158, 160 and 166 are not jointly shifted to enter the decoder outputs applied through OR gates 156, 162 and 164**. As will be seen, the absence of pulse POS stops the operating cycle in progress and the operator must intervene to restart it.

On the other hand, if a binary ONE signal appears on one of the decoder output leads **154*a*, 154*b*, 154*c*, and 154*d*, a binary ZERO is generated on output lead 154*e*. The output of gate 168 is thus held to a binary ONE, and gate 170 is enabled to route the pulse ROS through to trigger one-shot 172**. Pulse POS thus issues to shift the one binary ONE data entry signal into the first stage of the shift register to which it is applied, while a binary ZERO data entry signal is shifted into the first stage of each of the other two shift registers.

When an operating cycle is halted due to the appearance of a binary ONE on decoder output lead **154*e*, the operator is alerted, preferably by lighting a light at the console panel 28*a* (FIG. 1). The operator observes the cartridge, now located at the conveyor indexing position just beyond the loading station, to determine if the stoppage was due to an erroneous notch code reading. If the film manufacturer's label on the cartridge indicates that this cartridge contains film appropriate for sorting into one of the discharge stations of the apparatus 20, a selected pushbutton switch at console panel 28*a* is depressed to generate a binary ONE on the appropriate one of four manual data entry leads 174*a*, 174*b*, 174*c* and 174*d*, and binary ZEROS on the other three. Console panel output leads 174*a* and 174*b* are connected to OR gates 156 and 162, respectively, while output leads 174*c* and 174*d* are connected to an OR gate 174, whose output is connected to OR gate 164. As in the case of decoder output leads 154*c* and 154*d*, a binary ONE on one or the other of console panel leads 174*c* and 174*d* signifies the same film type but different numbers of exposures. At the same time, a binary ONE on one of these manual data entry leads is routed through OR gate 176 and OR gate 150 to act in lieu of the clocking pulse from notch reader 50 in triggering one-shot 152. Since flip-flop 131 will have since been reset by the trailing edge of the pulse from one-shot 132 issued on lead 132*b*, the output of gate 168 will at that time have assumed a binary ONE, even though a binary ONE remains on decoder output lead 154***e*. Thus pulse ROS is passed through gate 170 to trigger one-shot 172, and its output pulse POS shifts the shift registers to enter into their respective first stages the data entry made from the console panel 28*a*. Moreover, the issuance of pulse POS restarts the apparatus operating cycle.

If the operator determines upon inspection that the unsuccessfully read cartridge should not be off-loaded into any one of the discharge stations, it and its associated mailer are removed from their conveyor section for separate handling. The operator then loads another cartridge and associated mailer onto this conveyor section and effects the appropriate manual data entry, whereupon the operating cycle is restarted.

As previously noted, an operating cycle may be initiated without loading a cartridge and mailer onto a conveyor section at the loading station by depressing the step pushbutton 123. Flip-flop 125 is set and the signal SFS issues from AND gate 139 with the appearance of the sequencer output pulse on lead 134*c*. This signal is passed through OR gate 173 to trigger one-shot 172, whereupon its output pulse POS issues. In this case, it will be noted that all binary ZEROS are shifted into the first stages of the shift registers, in view of the absence of a cartridge notch code reading or a manual entry. As will be seen, this situation is recognized at the appropriate time so as to inhibit operation of label transport mechanism 62 when this empty conveyor section arrives at the labeling station 32.

Still referring to FIG. 11A, incident with each indexing of the conveyor 24, the contents of the shift registers are shifted one stage to the right. Thus a binary ONE entered in one of the shift registers for a particular cartridge, in effect, tracks its movement as it is indexed around by the conveyor. The number of stages of each shift register is determined by the number of conveyor steps its assigned discharge station is removed from the loading station. In the illustrated embodiment, if shift register 158 is assigned to discharge station 34, which from FIG. 2 is seen to be five conveyor steps from the loading station, this shift register has five stages. Shift register 160 has six stages inasmuch as its assigned discharge station 36 is six conveyor steps removed from the loading station. Finally, shift register 166 has seven stages since it requires seven conveyor steps to move a particular conveyor section from the load station to discharge station 38. Thus it is seen that when a binary ONE is entered into the first stage of one of the shift registers for a particular cartridge, this binary ONE is shifted into the last stage thereof when that particular cartridge arrives at the discharge station to which that shift register is assigned. As seen from FIG. 11A, a binary ONE in the last stage of shift register 158 enables an AND gate 159, while a binary ONE in the last stage of shift register 160 enables AND gate 161 and a binary ONE in the last stage of shift register 166 enables an AND gate 167. As described below, a one-shot multivibrator 250 in FIG. 11B is triggered to initiate the concluding step of each operating cycle, and its output pulse OLOS is commonly applied to the other input of each of the AND gates 159, 161, 167. If AND gate 159 is enabled, this pulse passes through as a pulse OLOS-A to energize a solenoid actuated valve 180 in FIG. 12, which opens to supply air from manifold 144 to jets 42*a* and 42*b*. As seen from FIG. 2, air emitted from these jets off-loads a cartridge and mailer into discharge station 34. Similarly, if AND gate 161 is enabled, pulse OLOS is passed as a pulse OLOS-B to energize valve 182 and the air emitted by jets 43*a* and 43*b* off-loads into discharge station 36 the cartridge and mailer on the conveyor section presented thereat. Finally, the pulse OLOS is passed through gate 167, when enabled, as an energizing pulse OLOS-C for valve 184, and the air blasts issuing from jets 44*a* and 44*b* blow a cartridge and mailer off into discharge station 38.

Turning to FIG. 11B, the data entries shifted in parallel into the first stages of shift registers 158, 160 and 166 by the output pulse POS are applied as separate inputs A, B and C directly to printer 74 and as respective one inputs to AND gates 200, 202 and 204. The other inputs to these gates are the respective contents of counters 206, 208 and 210. Since one of these data entries A, B and C is normally a binary ONE, one of the AND gates is enabled to pass the count content of one of the counters to an OR gate 212 and thence to printer 74. The pulse POS activates the printer to print on a mailer label 72*a* and a cartridge label 72*b* (FIG. 6) the count content of the one counter 206, 208, 210 gated through to the printer. The direct application of data entries A, B, C controls the printer to print on the mailer label 72*a* an appropriate prefix character identifying the type of film in cartridge. As previously noted, the cartridge label does not need this prefix character since the film type is indicated on the manufacturer's label borne by the cartridge. Also as previously discussed, a binary ONE for data entry C, derived from either decoder output leads 154*c* or 154*d*, or manual entry leads 174*c* or 174*d*, signifies a common film type calling for sorting into discharge station 38 and a common count accumulation in counter 210. However, a binary ONE on either decoder lead 154*c* or manual entry lead 174*c* signifies a cartridge containing, for example, twelve exposure film, while a binary ONE on either decoder lead 154*d* or manual entry lead 174*d* signifies twenty exposure film of the same type. It is desirable that this distinction be noted on the film and cartridge labels. To this end, as seen in FIG. 11A, decoder lead 154*d* and manual entry lead 174*d* are brought out separately to an OR gate 190, whose output is connected to a flip-flop 192 operating as a one-bit shift register. When a binary ONE appears on either of these leads, it is shifted into this flip-flop by the pulse POS issued by one-shot 172. The content to this flip-flop is supplied as a separate data entry D to printer. Thus, when data entries C and D are both binary ONE, the printer may be controlled to print a distinctive prefix character on both labels in conjunction with the film type prefix character on the mailer label and the count content of counter 210 on both labels. If the space available on the labels, particularly the smaller cartridge label, is insufficient to accommodate an additional prefix character, a binary ONE data entry D may be used to control the printer in printing the film type prefix and count in counter 210 in a different color on the two labels.

Upon printing the two labels, backing strip 70 is advanced by controlled actuation of stepping motor drive 80 (FIG. 6). To provide precise indexing of the label backing strip and thus uniform location of the print on the labels, a photodetector may be utilized in controlling the motor drive in a manner so as to uniformly reference the leading edges of the labels to be printed relative to the printer. Upon advancement of the backing strip, printer 74 issues a pulse on lead 220 to a second sequencer 222 which, in response, issues a succession of appropriately time spaced pulses on its output leads 222*a* through 222*e*. The first pulse in this succession, appearing on lead 222*a*, passes through an OR gate 224 and a normally enabled AND gate 226 to trigger a one-shot multivibrator 228. The resulting output pulse PKOS energizes a solenoid actuated valve 230 (FIG. 12) which opens to supply activating air from manifold 144 to air cylinders 90 and 91 (FIGS. 5 and 6) via their supply lines 90*a* and 91*a*, respectively. The plungers of these air cylinders reciprocate shoes 92 and 93 downwardly to pluck those labels 72*a* and 72*b* from the backing strip 70 which have just been advanced to the ready position where the backing strip is drawn around edge 76*a* of bar 76.

The next pulse issued by sequencer 222 appears on lead 222*b* and is utilized to trigger a one-shot multivibrator 232, whose pulse output TOS is supplied directly to a solenoid activated valve 234 and selectively via normally enabled AND gate 236 as a gated pulse GTOS to solenoid activated valve 238, both seen in FIG. 12. Valve 234 opens to supply activating air to cylinder 88, operating to swing the label transfer plate 86 from its label pickup position of FIG. 6 to its labeling position of FIG. 5. At the same time, assuming the mailer at the labeling station is not about to receive an additional label pursuant to a multiple order situation, valve 238 opens in response to pulse GTOS, and the resulting air blast emitted by jet 94 references the bottom edge of the mailer against pins 95 (FIG. 6). The sequencer output pulse on lead 222*b* is additionally utilized to increment the particular counter 206, 208 or 210 whose content was just previously gated into printer 74 for printing on the cartridge and mailer labels. To this end, data entries A, B and C, held in the first stages of shift registers 158, 160, 166 (FIG. 11A), are applied as respective one inputs to separated AND gates 207, 209 and 211, whose outputs are respectively applied to the increment inputs of counters 206, 208 and 210. The other input to each of these gates is the pulse on sequencer output lead 222*b*. Thus, the one of the data entries that was a binary ONE to gate the content of its associated counter into printer 74 via one of the gates 200, 202, 204 remains a binary ONE to enable one of the gates 207, 209, 211 when the pulse on sequencer output lead 222*b* appears. This pulse is thus passed through the one enabled gate to increment that same counter.

The next pulse issued by sequencer 222, appearing on lead 222*c*, is passed through OR gate 224 and normally enabled gage 226 to again trigger one-shot 228. A second pulse PKOS is generated to open valve 230, and cylinders 90 and 91 are activated once again to reciprocate shoes 92 and 93 downward, applying the labels to the cartridge and mailer presented at the labeling station. While the labels are being applied, sequencer 222 issues a pulse on lead 222*d* to trigger a one-shot multivibrator 240. This one-shot generates a pulse VOS which is fed to a solenoid activated valve 242 (FIG. 12). The normal condition of this valve connects shoes 92 and 93 to a vacuum pump 224 for creating adequate suction force at the bottom surfaces of the shoes to insure reliable pickup and retention of the labels. Then to insure reliable transfer of the labels from the shoes to the cartridge and mailer, valve 242 is momentarily activated by pulse VOS to connect the shoes to manifold 144 while cylinders 90 and 91 are being actuated to apply the sticky back labels. The suction hold on the labels is broken and, in fact, positive air pressure is exerted to assist in the label application. Pulse PKOS then terminates, allowing valve 230 to reclose and air cylinders 90 and 91 raise shoes 92 and 93 to their normal elevated positions. Pulse VOS terminates, and valve 242 restores the section force at the bottoms of the shoes. Finally, to complete the labeling cycle, pulse TOS terminates, closing valve 234, and cylinder 88 returns label transfer plate 86 to its label pickup position of FIG. 6. The sequencer pulse on lead 222*d* is also utilized as a reset pulse RSF for manual conveyor step flip-flop 125 of FIG. 11A.

The last pulse issued by sequencer 222 of FIG. 11B is supplied over lead 222*e* to trigger one-shot multivibrator 250 which then issues pulse OLOS already considered in connection with the discussion of FIG. 11A. It will be recalled that this pulse is applied as one input to each of the AND gates 159, 161 and 167 of FIG. 11A. The one of these gates that receives at its other input a binary ONE held in the last stage of the shift register 158, 160 or 166 passes pulse OLOS as pulse OLOS-A, OLOS-B or OLOS-C pursuant to off-loading a previously labeled cartridge and mailer at the appropriate discharge station. This concludes a complete operating cycle of the apparatus.

As previously noted in connection with FIG. 11B, AND gate 226 is normally enabled to permit the triggering of one-shot 228. Enablement of this gate pertains as long as a signal PKOK is a binary ONE. Turning to FIG. 11A, it is seen that this signal is developed at the output of an OR gate 252 whose inputs are derived from the content of the fourth stage of each of the shift registers 158, 160, 166. A binary ONE data entry shifted into one of these registers for a particular cartridge loaded onto the conveyor 24 at the loading station will be shifted into the fourth stage thereof when that cartridge arrives at the labeling station. Thus a binary ONE in the fourth stage of any one of the shift registers signifies that a cartridge has indeed been presented to the labeling station for labeling. The signal PKOK goes to a binary ONE, enabling gate 226 and the triggering of one-shot 228. Pulse PKOS issues to effect the initial plucking of the labels from the backing strip and their subsequent application to the cartridge and mailer. If there is no cartridge and mailer presented at the labeling station, a situation occurring when the conveyor is indexed to clear the conveyor by successive depressions of pushbutton switch 123 (FIG. 11A), there is no binary ONE in the fourth stage of any of the shift registers. Consequently the signal PKOK goes to a binary ZERO, disabling gate 226. While the apparatus goes through its operating cycle, the label picking and application steps are omitted. The awkward situation of having labels stuck to the conveyor table 25 is thus avoided.

Still to be considered is the control of the handling of a multiple order situation. It will be recalled that when the developed film from plural cartridges are to be returned in a single mailer, a first cartridge and a mailer are loaded onto one conveyor section, and the additional cartridges are loaded onto successive conveyor sections without accompanying mailers. It then remains for the labeling station to individually label the cartridges and multiply label the single mailer, as previously described. When the conveyor section bearing the first cartridge and the single mailer is presented at the labeling station, the next successive conveyor section carries a cartridge, but no mailer. The absence of a mailer is optically sensed by a photodetector including a light emitter 260*a* and receiver 260*b*, which, as seen in FIG. 2, are positioned beneath the conveyor table 25 to register with slot 25*b* of a conveyor section assuming the conveyor queuing position immediately preceding the labeling station conveyor position.

Returning to FIG. 11B, when the absence of a mailer is sensed, the output of photodetector 260 goes to a binary ZERO and is inverted to a binary ONE by an inverter 262 for application to a flip-flop 264 operating as a one-bit shift register. When one-shot 136 of FIG. 11A is triggered, its conveyor index initiating output pulse TTOS is utilized to shift this binary ONE into flip-flop 264 which then exhibits a binary ONE output for application to AND gate 266. The other input to this gate is derived from the reset output of a flip-flop 268 which had been reset at the conclusion of the previous operating cycle by the sequencer output pulse on lead 222*e* otherwise used to initiate conveyor off-loading. Thus gate 266 is enabled to generate an output signal LIFT which is supplied to solenoid activated valve 270 of FIG. 12. This valve opens to actuate air cylinder 96, which from FIGS. 5 and 7 is seen to operate in raising platform 98 and thereby elevate the mailer as the conveyor 24 is indexed to bring the next conveyor section to the labeling station. Then, when sequencer 222 issues a pulse on output lead 222*a* to initiate the picking of the labels off their backing strip, flip-flop 268 is set by this same pulse to disable gate 266. The signal LIFT disappears, and valve 270 closes, causing air cylinder 96 to lower platform 98. Thus the previously labeled mailer is placed on this next conveyor section to receive another label. In order that the indexing of the mailer achieved by roller 100 while the mailer was elevated is not disturbed by the action of air jet 94 (FIGS. 2 and 12), the binary ONE output of flip-flop 264 is inverted to a binary ZERO by an inverter 272 and utilized as an inhibiting signal MPI to disable gate 236. Thus, the pulse GTOS, normally issuing when one-shot 232 is triggered, is inhibited, and valve 238 remains closed to hold off the air blast normally issuing from mailer positioning air jet 94.

It will thus be seen that the objects set forth above, among those made apparent in the preceding description, are efficiently attained and, since certain changes may be made in the above constructions without departing from the scope of my invention, it is intended that all matter contained in the above description or shown in the accompanying drawings shall be interpreted as illustrative and not in a limiting sense.

Having described my invention, what I claim as new and desire to secure by Letters Patent is:

1. Apparatus for sorting film cartridges and correlating the cartridges with mailers to be used in returning developed film to their rightful owners; said apparatus comprising in combination:

A. a conveyor having a series of conveyor sections, each accommodating a cartridge and mailer in physically correlated relation;

B. a loading station at which said conveyor sections are successively presented for loading of a cartridge and mailer thereon;

C. means for indexing said conveyor in stepwise fashion;

D. a memory into which data identifying the type of film in each cartridge is successively entered;

E. a dual labeling station to which said conveyor sections are successively presented, said labeling station including transport means for applying to a cartridge and mailer thereat separate labels, each preprinted with unique, correlating indicia;

F. a plurality of discharge stations to which said conveyor sections are successively presented; and G. means controlled by the data in said memory for off-loading each labeled cartridge into a selected one of said discharge stations in accordance with the type of film therein.

2. The apparatus defined in claim 1, wherein said off-loading means jointly off-loads each cartridge and its label correlated mailer at a selected one of said discharge stations.

3. The apparatus defined in claim 1, wherein said labeling station includes a printer operating under the control of the film type identifying data to print the correlating indicia on the cartridge and mailer labels.

4. The apparatus defined in claim 3, which further includes a cartridge sensing station located between said loading and labeling stations, said cartridge sensing station including means for sensing the type of film in each cartridge and generating the film type identifying data for entry in said memory and for controlling said printer.

5. The apparatus defined in claim 4, which further includes means operable in lieu of said sensing means for manually generating film type identifying data for entry in said memory and for controlling said printer.

6. The apparatus defined in claim 5, wherein each cartridge includes a notch code identifying the film type therein, and said sensing means comprises a notch code reader.

7. The apparatus defined in claim 1, wherein each said discharge station includes a magazine, means operating incident with each indexing step of said conveyor to load into said magazine any cartridge off-loaded thereat, and means acting in response to the inability of said loading means to successfully load a cartridge into said magazine to inhibit further indexing of said conveyor by said indexing means.

8. The apparatus defined in claim 1, wherein said labeling station further includes a label supply roll comprising a backing strip having a succession of paired side-by-side labels lightly adhered thereto, a printer, and means for indexing said backing strip to successively present the paired labels to said printer for the printing of correlating indicia thereon.

9. The apparatus defined in claim 8, wherein said label transport means includes a carrier mounted for pivotal movement between a pickup position and a labeling position, a pair of label pickup shoes carried by said carrier, and actuating means automatically operating incident with each indexing step of said conveyor for actuating said shoes to individually pick the printed labels of a pair from said backing strip, pivot said carrier from its pickup position to its labeling position, and then actuate said shoes to apply the labels to the cartridge and mailer on the conveyor section presented at said labeling station.

10. The apparatus defined in claim 9, wherein said labeling station further includes means for registering the position of each mailer relative to said label transport means prior to the application of a label thereto.

11. The apparatus defined in claim 9, which further includes a source of pressurized air, a vacuum pump, a valve, and means controlling said valve to normally connect said shoes to said vacuum pump to create a suction force promoting the pickup and retention of the labels by said shoes and connecting said shoes to said source of pressurized air while the labels are being applied to the cartridge and mailer presented to the labeling station.

12. The apparatus defined in claim 9, which further includes means monitoring the date content of said memory and operating to automatically inhibit said pickup shoe actuating means when a conveyor section devoid of a cartridge and mailer is presented at said labeling station.

13. The apparatus defined in claim 6, wherein said memory includes a separate shift register associated with each said discharge station, each said shift register having plural stages equal to the number of conveyor steps its associated discharge station is removed from said cartridge sensing station, said apparatus further including a decoder operating to resolve the film type identifying data output of said notch code reader into a single digital bit for entry into the first stage of an appropriate one of said shift registers, and means operating incident with each indexing step of said conveyor to jointly shift said shift registers such that the digital bits in said shift registers track the movements of their associated cartridges by said conveyor, said off-loading means being selectively operated by the existence of a digital bit in the last stage of any one of said shift registers.

14. The apparatus defined in claim 13, which further includes a separate counter assigned to each associated discharge station and shift register, and means controlled by the existence of a digital bit in the first stage of one of said shift registers for gating the content of the assigned counter to said printer for joint printing on a cartridge label and a mailer label and for incrementing said assigned counter.

15. The apparatus defined in claim 14, wherein a digital bit in the first stage of any one of said shift registers is applied directly to said printer to control the printing of film type identifying indicia exclusively on the mailer label.

16. The apparatus defined in claim 1, which further includes means responsive to the joint loading of a mailer and a cartridge on a conveyor section at said loading station for automatically initiating operation of said conveyor indexing means.

17. Apparatus for handling film cartridges and for correlating the cartridges with mailers to be used in returning developed film to their rightful owners; said apparatus comprising in combination:

A. a conveyor having a series of conveyor sections;

B. a loading station at which said conveyor sections are successively presented for loading thereon of a cartridge and mailer in physically correlated relation, in the case of a multiple order where plural cartridges are received from a common owner, one of the plural cartridges together with a mailer are loaded on one conveyor section with the remaining cartridges of the multiple order being individually loaded on successive conveyor sections without mailers;

C. means for indexing said conveyor;

D. a dual labeling station to which said conveyor sections are successively presented;

E. label transport means at said labeling station for applying to the cartridge and mailer thereat separate labels, each preprinted with unique, correlating indicia;

F. a detector for signalling the absence of a mailer on the conveyor section in line to be next indexed to said labeling station;

G. mailer handling means at said labeling station operating in response to the signalling of said detector for removing the previously labeled mailer from the conveyor section thereat and placing it on the next succeeding conveyor section upon its being indexed to said labeling station, said label transport means applying a label to the cartridge and a second label to the mailer, each preprinted with unique, correlating indicia; and H. at least one discharge station to which said conveyor sections are successively presented and into which the labeled cartridges are off-loaded.

18. The apparatus defined in claim 17, which further includes positioning means for adjusting the location of a mailer on its conveyor section to a reference position upon arrival at said labeling station to receive a first label, said mailer handling means further operating to positionally increment a mailer while removed from a conveyor section such that its placement on a next succeeding conveyor section is displaced from said reference position, and means responsive to said detector for inhibiting said positioning means, whereby a second label is not applied to a mailer by said transport means in obscuring relation to a first applied label.

19. The apparatus defined in claim 18, wherein said mailer handling means includes a platform situated in underlying relation with a portion of a mailer in its reference position at said labeling station, and actuating means operating in response to said detector to raise said platform, thereby lifting the mailer off its original conveyor section and holding it aloft to await the arrival of the next succeeding conveyor station at said labeling station whereupon said platform is lowered to place the mailer thereon.

20. The apparatus defined in claim 19, wherein said mailer handling means further includes a roller engaging the mailer while held aloft by said platform, and means for incrementally rotating said roller to positionally increment the mailer.

21. The apparatus defined in claim 18, which further includes a memory into which data identifying the type of film in each cartridge is successively entered, and means controlled by the data in said memory for off-loading each labeled cartridge into a selected one of plural discharge stations to which said conveyor sections are successively presented.

22. The apparatus defined in claim 21, wherein said off-loading means jointly off-loads each cartridge and its label correlated mailer at a selected one of said discharge stations.

23. The apparatus defined in claim 22, wherein said labeling station includes a printer operating under the control of the film type identifying data to print the correlating indicia on the cartridge and mailer labels.

24. The apparatus defined in claim 23, which further includes a cartridge sensing station located between said loading and labeling stations, said cartridge sensing station including means for sensing the type of film in each cartridge and generating the film type identifying data for entry in said memory and for controlling said printer.

25. The apparatus defined in claim 24, which further includes means operable in lieu of said sensing means for manually generating film type identifying data for entry in said memory and for controlling said printer.

26. The apparatus defined in claim 25, wherein said cartridge includes a notch code identifying the film type therein, and said sensing means comprises a notch code reader.

27. The apparatus defined in claim 26, wherein each said discharge station includes a magazine, means operating incident with each indexing step of said conveyor to load into said magazine any cartridge off-loaded thereat, and means acting in response to the inability of said loading means to successfully load a cartridge into said magazine to inhibit further indexing of said conveyor by said indexing means.

28. The apparatus defined in claim 27, wherein said labeling station further includes a label supply roll comprising a backing strip having a succession of paired side-by-side labels lightly adhered thereto, and means for indexing said backing strip to successively present the paired labels to said printer for the printing of correlating indicia thereon.

29. The apparatus defined in claim 28, wherein said label transport means includes a carrier mounted for pivotal movement between a pickup position and a labeling position, a pair of label pickup shoes carried by said carrier, and actuating means automatically operating incident with each indexing step of said conveyor for actuating said shoes to individually pick the printed labels of a pair from said backing strip, pivot said carrier from its pickup position to its labeling position, and then actuate said shoes to apply the labels to the cartridge and mailer on the conveyor section presented at said labeling station.

30. The apparatus defined in claim 29, which further includes a source of pressurized air, a vacuum pump, a valve, and means controlling said valve to normally connect said shoes to said vacuum pump to create a suction force promoting the pickup and retention of the labels by said shoes and connecting said shoes to said source of pressurized air while the labels are being applied to the cartridge and mailer presented to the labeling station.

31. The apparatus defined in claim 29, which further includes means monitoring the data content of said memory and operating to automatically inhibit said pickup shoe actuating means when a conveyor section devoid of a cartridge and mailer is presented at said labeling station.

32. The apparatus defined in claim 26, wherein said memory includes a separate shift register associated with each said discharge station, each said shift register having plural stages equal to the number of conveyor steps its associated discharge station is removed from said cartridge sensing station, said apparatus further includes a decoder operating to resolve the film type identifying data output of said notch code reader into a single digital bit for entry into the first stage an appropriate one of said shift registers, and means operating incident with each indexing step of said conveyor to jointly shift said shift registers such that the digital bits in said shift registers track the movements of their associated cartridges by said conveyor, said off-loading means being selectively operated by the existence of a digital bit in the last stage of any one of said shift registers.

33. The apparatus defined in claim 32, which further includes a separate counter assigned to each associated discharge station and shift register, and means controlled by the existence of a digital bit in the first stage of one of said shift registers for gating the content of the assigned counter to said printer for joint printing on a cartridge label and a mailer label and for incrementing said assigned counter.

34. The apparatus defined in claim 33, wherein a digital bit in the first stage of any one of said shift registers is applied directly to said printer to control the printing of film type identifying indicia exclusively on the mailer label.

35. The apparatus defined in claim 34, wherein said printer is conditioned in response to the coincidence of a digital bit in a predetermined one of said shift registers and a unique digital bit output from said decoder to print on said labels the count content of the counter associated with said predetermined one shift register in a unique color.

* * * * *